US009848739B2

(12) United States Patent
Ahmes et al.

(10) Patent No.: US 9,848,739 B2
(45) **Date of Patent: *Dec. 26, 2017**

(54) BATHTUB FITTING STANDARD EXTERNAL SPACE WHILE AFFORDING LARGER FLOOR AREA AND ENCLOSED VOLUME

(71) Applicants: Bruce Ahmes, St. James, NY (US); Ryan Ahmes, Brightwaters, NY (US); Kenneth Piccininni, Hauppauge, NY (US)

(72) Inventors: Bruce Ahmes, St. James, NY (US); Ryan Ahmes, Brightwaters, NY (US); Kenneth Piccininni, Hauppauge, NY (US)

(73) Assignee: Brak Tub Corp., Brightwaters, NY (US)

( * ) Notice: Subject to any disclaimer, the term of this patent is extended or adjusted under 35 U.S.C. 154(b) by 95 days.

This patent is subject to a terminal disclaimer.

(21) Appl. No.: 14/688,413

(22) Filed: Apr. 16, 2015

(65) Prior Publication Data

US 2016/0220073 A1 Aug. 4, 2016

Related U.S. Application Data

(63) Continuation of application No. 29/521,732, filed on Mar. 26, 2015, now Pat. No. Des. 737,416.

(60) Provisional application No. 62/111,453, filed on Feb. 3, 2015.

(51) Int. Cl.

| | |
|---|---|
| *A47K 3/02* | (2006.01) |
| *A47K 3/04* | (2006.01) |
| *A47K 3/00* | (2006.01) |

(52) U.S. Cl.
CPC ..... *A47K 3/04* (2013.01); *A47K 3/001* (2013.01); *A47K 3/02* (2013.01)

(58) Field of Classification Search
CPC ..... A47K 3/04; A47K 3/001; A47K 3/02
USPC ..... 4/584
See application file for complete search history.

(56) References Cited

U.S. PATENT DOCUMENTS

| | | | | |
|---|---|---|---|---|
| 531,710 A | | 1/1895 | Wheeler | |
| D25,896 S | | 8/1896 | Arrott | |
| D73,911 S | | 11/1927 | Henricks | |
| 1,811,896 A | | 6/1931 | Ross | |
| 1,929,480 A | * | 10/1933 | Cappuccio | A47K 3/02 4/584 |
| D119,528 S | | 12/1937 | Wendland | |

(Continued)

FOREIGN PATENT DOCUMENTS

JP 2012228406 A 11/2012

*Primary Examiner* — Tuan N Nguyen
(74) *Attorney, Agent, or Firm* — Alfred M. Walker

(57) ABSTRACT

A bathtub with a limited rectangular footprint and an optimized floor space is formed with a substantially planar base with a length and width that define the limited rectangular footprint and a front wall, a back wall, a first side wall and a second side wall integral with and extending substantially vertically upwards from the substantially planar base. Each of the front, back, first side wall and second side wall have minimal wall thicknesses to define the optimized floor space and the front wall has a substantially planar upper apron deck that extends inwardly from an outer substantially vertical front wall surface for a fixed amount in a substantially parallel relation to the substantially planar base.

4 Claims, 6 Drawing Sheets

(56) References Cited

U.S. PATENT DOCUMENTS

| | | | | | |
|---|---|---|---|---|---|
| 2,163,154 | A | * | 6/1939 | Radimsky | A47K 3/02 4/590 |
| 2,333,491 | A | * | 11/1943 | Plante | A47K 3/04 4/584 |
| 2,341,475 | A | | 11/1947 | Gruen | |
| 2,841,795 | A | | 7/1958 | Pelicano | |
| D199,781 | S | | 12/1964 | Clavarino | |
| D212,452 | S | | 10/1968 | DeVane | |
| D236,619 | S | | 9/1975 | Powell | |
| 4,099,280 | A | | 7/1978 | Hoppe et al. | |
| D253,368 | S | | 11/1979 | Johansson | |
| 4,316,294 | A | | 2/1982 | Baldwin | |
| D266,947 | S | | 11/1982 | Topete | |
| 4,357,721 | A | * | 11/1982 | Newburger | A47K 3/06 4/584 |
| D279,028 | S | | 5/1985 | Kohler | |
| D335,701 | S | | 5/1993 | Zaccai | |
| 5,303,519 | A | | 4/1994 | Mustee et al. | |
| 5,758,369 | A | | 6/1998 | Takahashi | |
| 5,911,943 | A | | 6/1999 | Minghetti et al. | |
| 7,299,509 | B1 | | 11/2007 | Neidich | |
| D577,108 | S | | 9/2008 | Piatt | |
| 7,490,371 | B2 | | 2/2009 | Torres | |
| D600,330 | S | | 9/2009 | Barba | |
| D619,685 | S | | 7/2010 | Hoernig | |
| D633,603 | S | | 3/2011 | Su | |
| D694,865 | S | | 12/2013 | Licini | |
| D697,182 | S | | 1/2014 | Lutz | |
| D709,598 | S | | 7/2014 | Dupras | |
| 9,321,191 | B2 | | 4/2016 | Doss | |
| 2005/0246830 | A1 | | 11/2005 | Galyean, Jr. et al. | |
| 2011/0167728 | A1 | | 7/2011 | Alelov | |

* cited by examiner

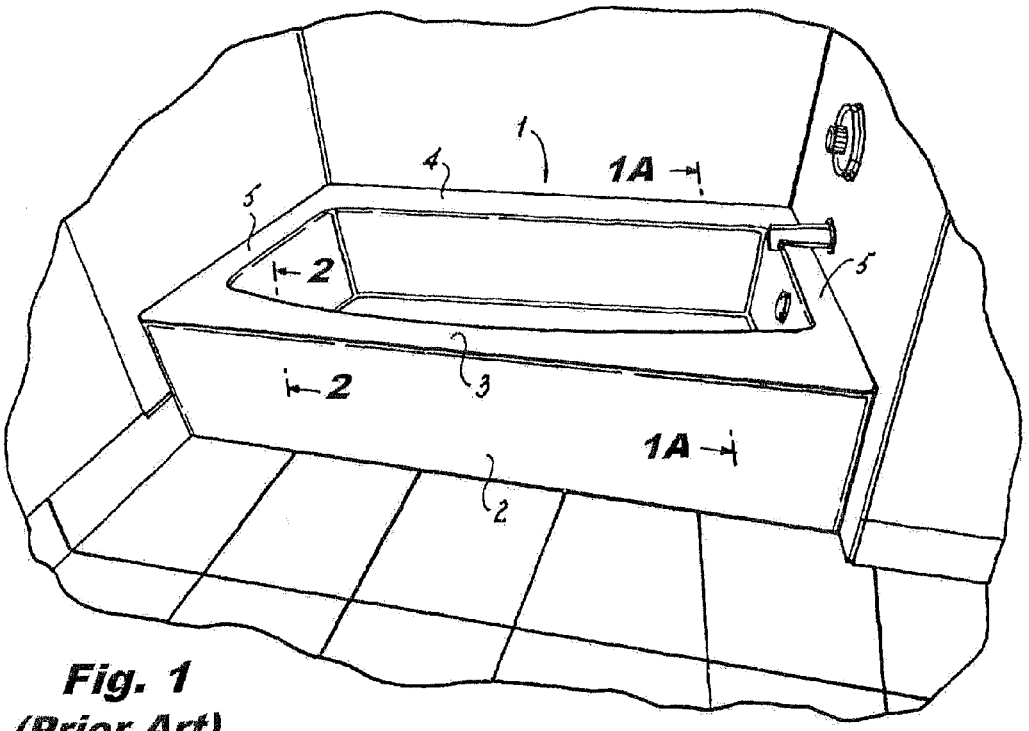
Fig. 1
(Prior Art)
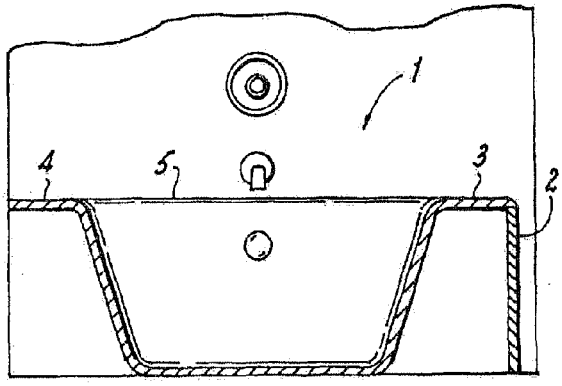
Fig. 1A
(Prior Art)
Fig. 2
(Prior Art)
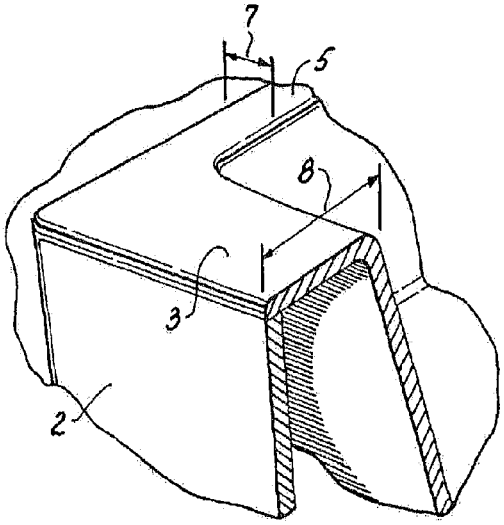

BATHTUB FITTING STANDARD EXTERNAL SPACE WHILE AFFORDING LARGER FLOOR AREA AND ENCLOSED VOLUME

RELATED APPLICATIONS

This application claims the benefit of provisional patent application No. 62/111,453 filed Feb. 3, 2015 ("the '453 application") under 35 USC §119(e). The '453 application is incorporated by reference herein. This application also claims priority under 35 USC §120 from design patent application Ser. No. 29/521,732 (the '732 application), filed Mar. 26, 2015. The '732 application is incorporated by reference herein.

FIELD OF THE INVENTION

The present invention relates to maximizing internal bathtub/shower stall space within predetermined confines of typical residential bathroom space dimensions.

BACKGROUND OF THE INVENTION

When viewed in crossection from an end, conventional prior art bathtubs have limited interior bathing space by virtue of the fact that the upper apron deck provided for sliding glass doors is usually three or more inches in top width, which narrows considerably the interior bathing or showering space or volume within the conventional bathtub. Additionally, for symmetry purposes, a similar opposite wall abutting top edge is also typically three or more inches in top width, thereby further limiting the space or volume within the bathtub. Typical residential bathrooms generally have a limited rectangular footprint area of 60 inches by 30 or 32 inches within which to locate a bathtub and shower installation. So losing 1, 2, 3 or 4 inches in width results in a significant reduction in the overall internal space or volume within a typical bathtub.

Among known prior art patents includes U.S. Pat. No. 2,431,475 of Gruen, which discloses the elimination of a front bathtub apron wall and the creation of an apron effect, by providing a front wall having an upper edge wall fanning outward, both inside the tub and outwards from the front of the tub, to prevent water from splashing out of the bathtub.

US Patent Application 2011/0167728 of Alelov discloses an "Expandable Side Enclosure for Bathtubs/Showers", to provide a solution to prevent arm movement restrictions caused to bathers in bathtubs and/or showers due to the lack of free body and limb movement in baths with standard enclosures. While Alelov provides outwardly extended bay-type windows in the sliding glass doors, which are at standing arm height, to provide more movement of the arms during a shower. However, Alelov does not increase the internal volume of the bathtub itself.

U.S. Pat. No. 1,811,896 of Ross discloses a circular topped truncated conical water basin/bowl/tub with an inwardly inverted anti-splash lip/flange. However, Ross cannot be installed in a typical rectangular bathtub footprint in a residential bathroom.

U.S. Design Patent D619,685 of Hoernig discloses a shower and tub with a "flip up out of the way" apron deck, to expand the interior space of the bathtub. However, Hoernig requires moving parts and hinges, which are complicated and detrimental in a high humidity bathtub environment.

U.S. Design Patent Des. 335,701 of Zaccui discloses a bathtub which increases interior space by having bulging outwardly extending side walls. However, the bulging sides of Zaccui '701 prevents its installation within a standard bathtub area.

These known prior art devices do not maximize internal bathtub/shower stall space within the predetermined confines of typical residential bathroom space dimensions. The use of the an inwardly extending only cantilevered top apron edge in the present invention for an expanded space bathtub, where the rear wall has no apron edge, would be discouraged, if not clearly taught away from the prior art patents.

Therefore, the use of a bathtub with both an inwardly extending apron deck and an expanded footprint and volume for the bathtub, as in Applicants' present invention, in conjunction with the spatial confines of a rectangular bathtub installation area of a residential bathroom, is not only not suggested, but would be discouraged or taught away by the designs known from the conventional arts.

OBJECTS OF THE INVENTION

The objective of this invention is to provide a bathtub that fits within standard tub dimensions but has a larger internal floor area and larger volume within. Most bathtubs are used for taking showers but are dimensioned for tub use. The inventive bathtub better accommodates its shower use while still affording the choice of use as a soaking tub. The larger interior floor area of the bathtub simulates the feel of a larger shower by being less confining.

This objective is achieved in the inventive bathtub design by use of thin front, back and side walls. The front deck width still is maintained to accommodate sliding door tracks thereon, however, to support sliding glass doors. The side decks and back deck are just the thickness of the tub material. The front deck is maintained with a width of up to a maximum of 3.5 inches, according to a width required to accommodate siding door tracks, but it is cantilevered from the front vertical surface of the front wall inward and then rejoins the thin front wall at near the top of the rear vertical surface of the front wall thereby realizing a tub that does not suffer a reduction in the interior floor space by the front deck width. The floor area covered by a projection of the front deck is usable space for visual appearance as well as actual space for feet while standing and taking a shower

SUMMARY OF THE INVENTION

The bathtub of the present invention has with a limited rectangular footprint and an optimized floor space, including:

a substantially planar base with a length and width that define the limited rectangular footprint;

a front wall, a back wall, a first side wall and a second side wall integral with and extending substantially vertically upwards from the substantially planar base;

wherein each of the front, back, first side wall and second side wall have minimal wall thicknesses to define the optimized floor space, and wherein the front wall has a substantially planar upper apron deck that extends inwardly from an outer substantially vertical front wall surface for a fixed amount in a substantially parallel relation to the substantially planar base.

The substantially planar upper apron deck is preferably cantilevered inwardly from the top horizontal surface of the front wall of the bathtub.

The bathtub's front wall is arranged in opposing relation to the back wall and the first side wall is arranged in opposing relation to the second side wall such that all of the walls are integrally joined to define the inner bathtub volume therebetween.

The bathtub's minimal wall thickness is a minimum thickness to which the walls can be manufactured and maintain structural integrity, wherein the minimal thickness to which the wall can be manufactured is dependent on a material composition of the walls.

The bathtub's substantially planar upper apron deck extends inwardly between and integrally connected to upper portions of the first side wall and the second side wall, in a substantially parallel relation to substantially planar base.

While dimensions may vary, preferably the limited rectangular footprint of the base of the bathtub is approximately 1419 square inches.

The bathtub has a distance between an inner surface of the front and back walls and a distance between an inner surface of the first and second side walls, measured at an upper surface of the substantially planar base and a lower inner surface of the substantially planar upper apron deck, respectively, and a minimal distance between the upper surface of the substantially planar base and the lower inner surface of the substantially planar upper apron deck, define an inner air volume of the bathtub.

While dimensions may vary, preferably the Interior air volume is approximately 20,845 cubic inches.

Preferably the bathtub's thickness of the substantially planar upper apron deck is less than or equal to the thickness of the front wall, and wherein the thickness of the substantially planar upper apron deck is a minimum thickness to which the upper apron deck can be manufactured and maintain structural integrity.

One wall of the first side wall and the second side wall extends vertically at an angle that is greater than 90° between a plane of the base and a plane of the one of the first side wall and the second side wall.

Preferably, the inner corners formed by vertical ends of the first and second side walls of the bathtub, with vertical ends of the front and back walls, are substantially rounded.

Also preferably, the inner corners between lower ends of the first and second side walls and the front and back walls and, an inner surface of the substantially planar base are substantially rounded.

The bathtub's one or more first and second side walls extend inwardly from an outer substantially vertical wall surface of the one or more first and second side walls for a fixed amount, in a substantially parallel relation to the substantially planar base.

Also preferably, the bathtub's front wall and rear wall each have a thickness of about one inch.

Preferably, the bathtub's front wall and rear wall are tapered, with a top thickness of about one inch and with a bottom thickness of about one and one quarter inch in thickness.

The bathtub also may optionally have hollow interiors, wherein the front wall is hollow, with an outer front wall of about one quarter inch in thickness and an inner front wall of about one quarter inch in thickness, further with a hollow air space therebetween.

The bathtub's rear wall may also optionally have a front rear wall of about one quarter inch in thickness, and a hollow air space of about three quarter inches extending behind the front rear wall up to the surface of the bathroom wall, to accommodate tile and tile grout therebetween.

BRIEF DESCRIPTION OF THE DRAWINGS

The present invention can best be understood in connection with the accompanying drawings. It is noted that the invention is not limited to the precise embodiments shown in the accompanying drawings, in which:

FIG. 1 is a perspective view of a portion of a bathroom enclosing a prior art bathtub;

FIG. 1A is a cross-sectional view of a prior art bathtub with a limited space interior;

FIG. 2 is a perspective detail in partial crossection of a front corner of the prior art tub showing the front deck width;

DETAILED DESCRIPTION OF THE INVENTION

Figure 3:
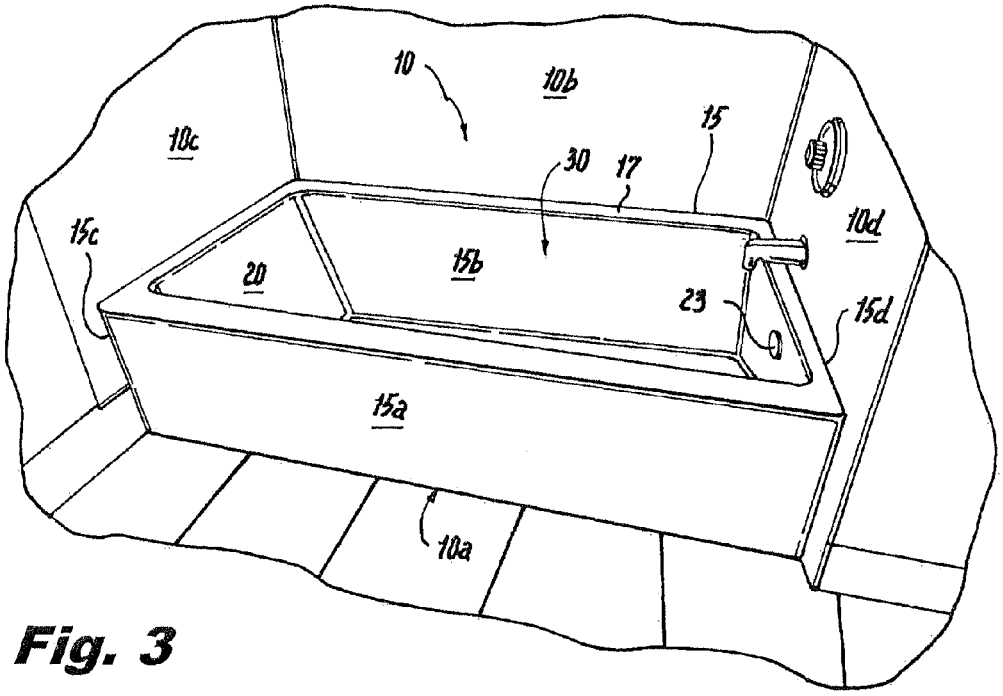
FIG. 3 is perspective view of a portion of a bathroom enclosing the bathtub of this invention.

As shown in Prior Art drawing FIGS. 1 and 2, the prior art tub 2 in bathroom 1 as shown in FIG. 1 is meant to represent any commonly available design. Front deck 3, back deck 4 and side decks 5 are shown. FIG. 2 is a close-up showing the typical wide dimension 8 of front deck 3 as well as the narrower side decks 5 dimension 7.

Figure 4:
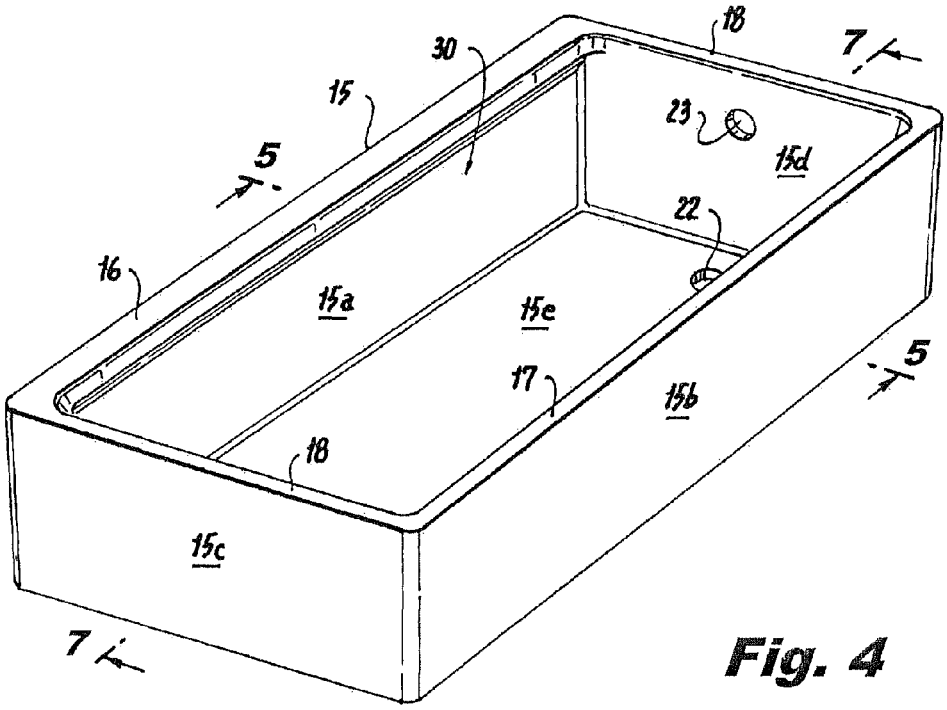
FIG. 4 is a perspective view of the bathtub of this invention.
Figure 5:
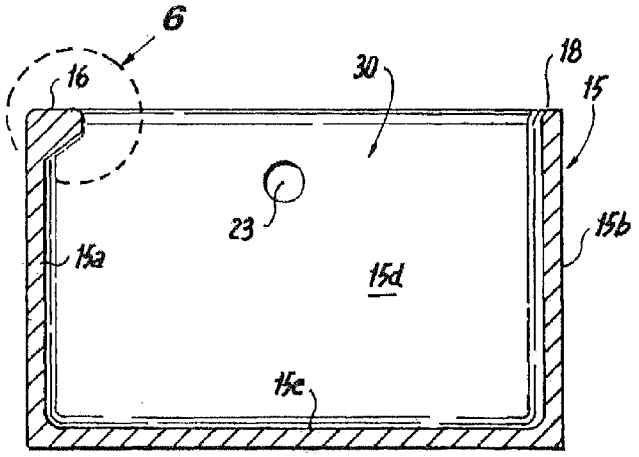
FIG. 5 is an end view crossection showing the profile of the cantilevered front deck.
Figure 6:
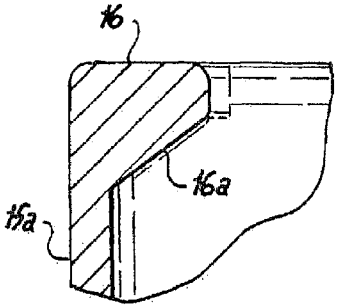
FIG. 6 is an enlarged cross-section detail of the cantilevered front deck.
Figure 5A:
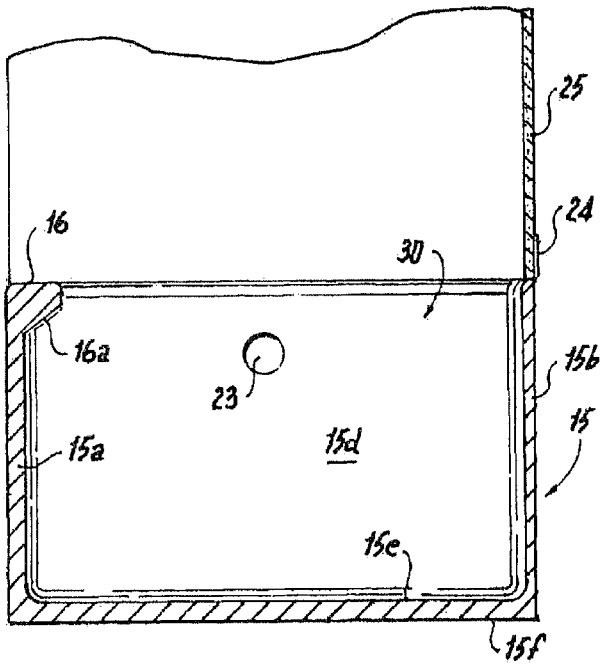
FIG. 5A is an end view crossection of an alternate embodiment, showing the profile of the cantilevered front deck.
Figure 7:
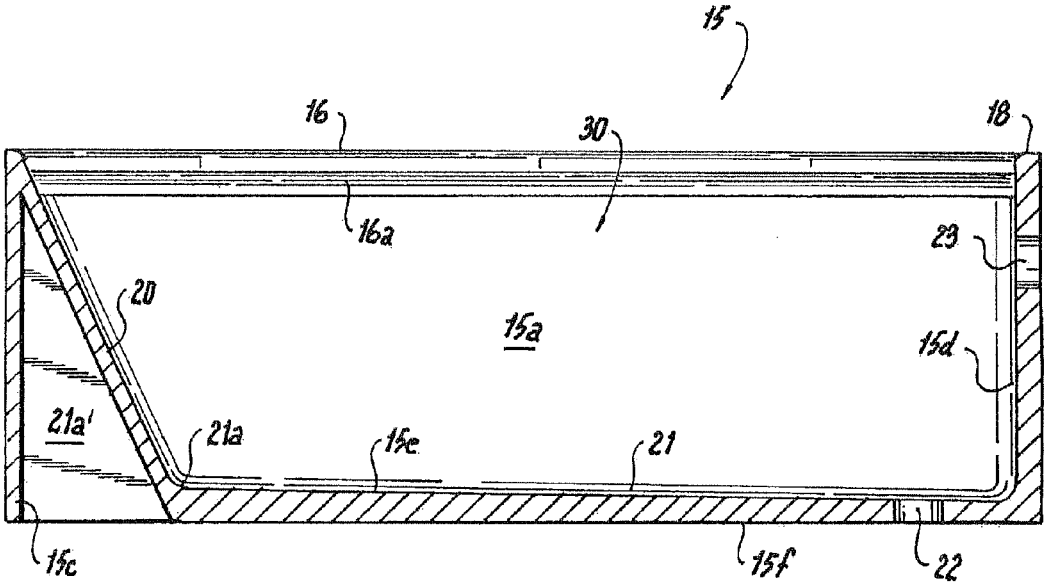
FIG. 7 is a side cross-section view of the bathtub of this invention.

FIGS. 3-7 pertain to the bathtub of this invention. FIG. 3 shows tub 15 in bathroom 10 which is of the same dimensions as bathroom 1 in FIG. 1. FIG. 4 shows tub 15 in a perspective view with back deck 17 in the forefront and front deck 16 at the far side. It is noted that side decks 18 as well as back deck 17 have wall widths that are equivalent to the thickness or width of the material comprising the side walls, the back wall and the front wall below the front deck. The crossectional views of FIGS. 5, 5A and 6 show the cantilevered shape of front deck 16 in detail, highlighting that the front deck width does not encumber the interior width of the tub floor. It is further noted that the width dimension 19 is the same as dimension 8 in prior art FIG. 2. FIG. 7 is a length wise crossection showing sloping backrest 20 and slight drain slope 21, which is preferred. In these figures, large sections are shown as being solid material just for interior dimensional clarity, however they may in fact have enclosed air spaces. This would be especially true of the large wedge shape under back rest 20 and the cantilevered front deck as in FIG. 6; it would depend on the material used and method of construction.

An expanded space bathtub 15 fits in standard tub dimensions of bathroom 10 having footprint floor area 10*a* and vertically extending bathroom wall surfaces 10*b*, 10*c* and 10*d*, and has a larger internal floor area 15*e* of bottom base wall 15*f*, and larger air volume 30 within. The bathtub 15 includes thin walls, including four vertically extending walls, including front wall 15*a*, rear wall 15*b*, left side wall

15*c* with sloping backrest 20 adjacent thereto and separated from left side wall 15*c* by hollow interior area 21*a*', and right side wall 15*d* having trip lever hole 23. Vertical walls 15*a*, 15*b*, 15*c* and 15*d* extend vertically upward from rectangular bottom base wall 15*f* having an exterior footprint to fit within the pre-determined rectangular bathtub insertion floor footprint area 10*a* of bathroom 10. Bottom base wall 15*f* has an interior footprint 15*e*, which, with the inside surfaces of vertically extending walls 15*a*, 15*b* 15*c* and sloping backrest wall 20 of left side wall 15*c*, define the enlarged air volume 30 extending therebetween.

The thickness of the vertical walls 15*a*, 15*b*, 15*c*, 15*d* and sloping side backrest 20 is preferably one inch in thickness near the top, up to about one and one quarter inches on the bottom, to provide a slightly sloped surface for easy removal of the tub from a mold. The one inch and one and one quarter inch dimensions need not be solid, so that a wall (not shown) having a thickness of one quarter inch on each side can have a hollow interior of one half inch. A similar hollow area can be provided at the slightly wider bottom width of one and one quarter inches total, combined with the walls and hollow interior. Moreover, for the rear, wall facing wall 15*b*, the wall 15*b* can be just one layer of one quarter inch in thickness, with a three quarter inch hollow area behind the one quarter inch wall, up to the bathroom wall surface 25 itself. The one inch thickness at the top 17 of rear wall 15*b* is required to accommodate tiles of up to ⅝ inch in thickness and accompanying grout against the bathroom wall surface 25. As shown in FIG. 5A, an optional attachment flange 24 can be attached to rear wall 15*b* for attachment to bathroom wall surface 25.

Also preferably, the bathtub 15's front wall 15*a* and rear back wall 15*b* each have an optional thickness of about one inch.

Figure 5B:
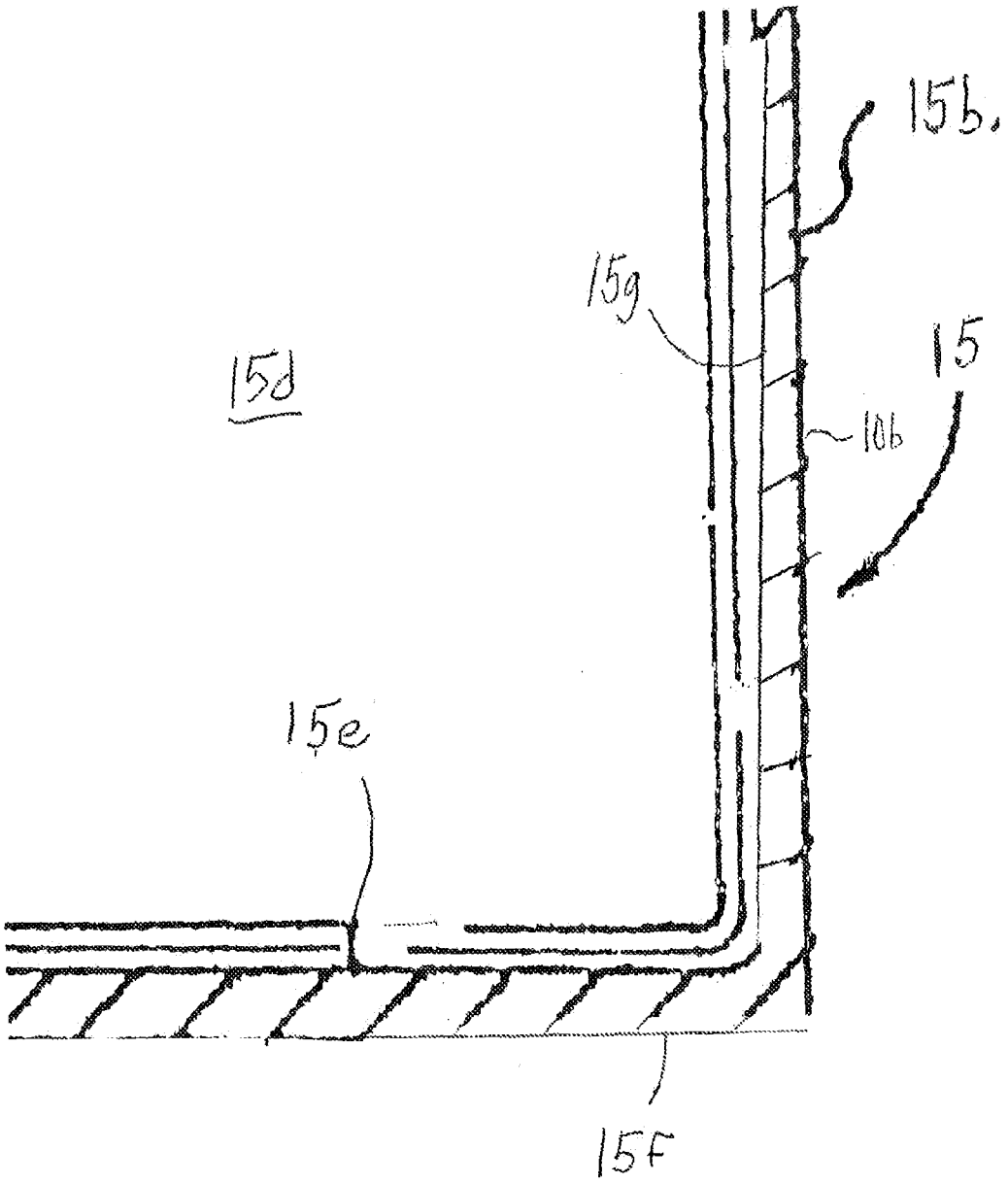
FIG. 5B is a close-up enlarged crossectional detail view of an optional portion of the rear wall of the bathtub, the front wall being an optional mirror view thereof.

Optionally, as shown in FIG. 5B, the bathtub's front wall 15*a*, and rear back wall 15*b*, are tapered along tapered surface 15*g*, with a top thickness of about one inch and with a bottom thickness of about one and one quarter inch in thickness.

Figure 5C:
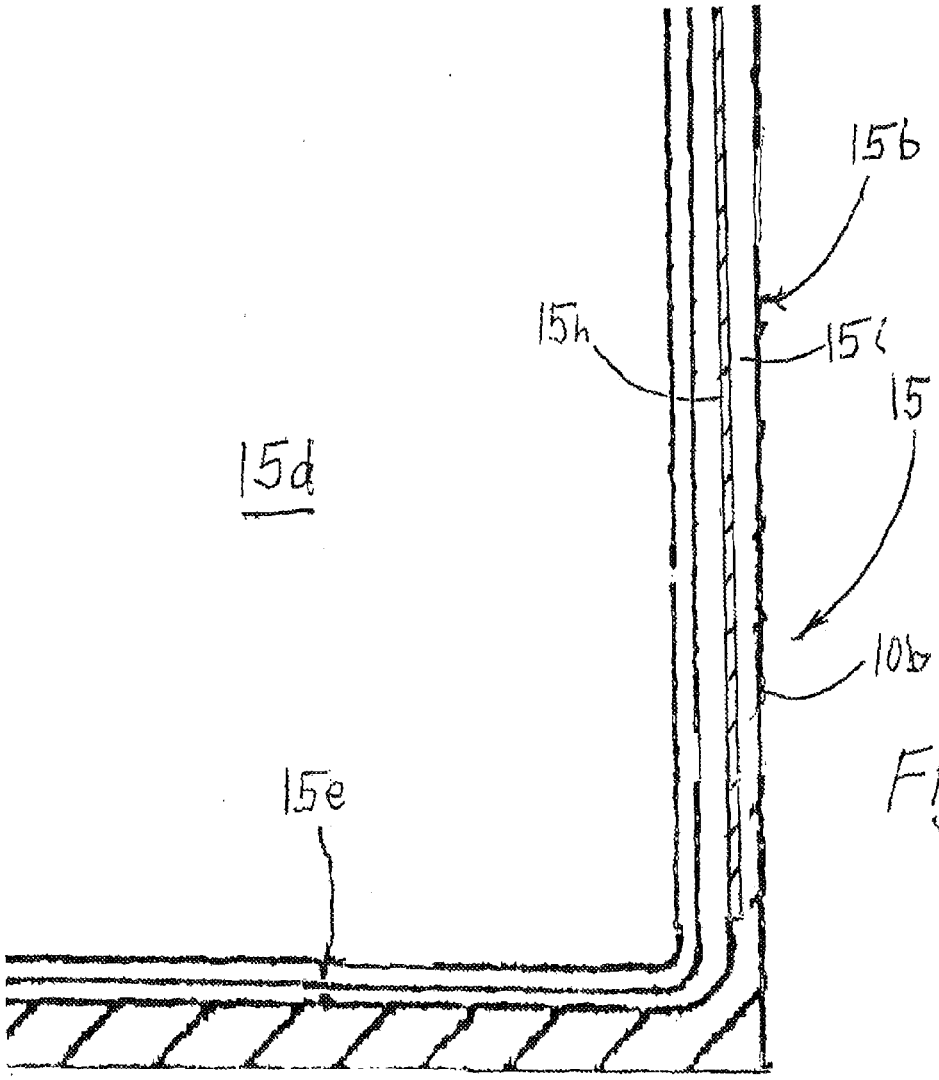
FIG. 5C is a close-up enlarged crossectional detail view of an optional back wall with a thin, front wall position and an air space behind it, the front wall being an optional mirror image thereof.

As shown in FIG. 5C, the bathtub 15's rear wall 15*b* may optionally have a front rear wall portion 15*h* of about one quarter inch in thickness and a hollow air space 15*i* of about three quarter inches extending behind the front rear wall portion 15*h*, up to the surface of the bathroom wall 10*b*, to accommodate tile and tile grout therebetween.

Similar to rear back wall 15*b* shown in FIG. 5C, front wall 15*a* (optionally a mirror image of rear back wall 15*b*), also may optionally have a hollow interior, wherein the front wall 15*a* is also hollow, with an outer front wall portion of about one quarter inch in thickness and an inner front wall portion of about one quarter inch in thickness, further with a hollow air space therebetween, where the inner front wall portion of front wall 15*a* is positioned similar to positioning of the room wall 10*b* behind air space 15*i* of rear back wall 15*b* in FIG. 5C.

As shown in the crossectional view of FIG. 7, the inside bottom footprint 15*e* of bottom base wall 15*f* preferably has a slope 21, sloping downward from the corner 21*a* defined by sloping backrest 20 and an adjacent edge of interior footprint 15*e* of bottom base wall 15*f*, downwards towards water drain hole 22.

The front apron deck 16's width of up to a maximum of 3.5 inches is maintained within normal construction requirements to support the sliding glass door tracks, but without the need for limiting interior bathtub volume with thick walls. The side decks 18 and back deck 17 are limited to the thickness of the tub material. The front apron deck 16 has a width which is maintained to industry standards to support sliding shower wall tracks thereon, but it is cantilevered from the front surface of front wall 15*a* inward and then rejoins the thin inner wall of the front wall 15*a* where its inwardly preferably curved backwards undersurface wall 16*a* meets near the top of the inner surface of front wall 15*a* of bathtub 15, thereby not reducing the interior floor space 15*e* or the interior air volume 30 by the front deck 16's width. The bathtub 15 therefore maximizes internal bathtub/shower stall space within the predetermined confines of typical residential bathroom bathtub and shower space dimensions.

The bathtub 15 of this invention can be made of steel or plastic resin materials and finished as is common in the industry.

A comparison of the interior floor space and enclosed air volume (to the top edge of all four vertical walls the tub) has been made to compare a prior art tub and a tub of this invention of the same external dimensions. A prior art front deck of 4" and a back deck of 3" with side decks of 2" in a 60 inch external length by 30 inch tub of 15" average internal depth was assumed for comparison. The wall thickness of the tub of this invention is assumed to be 1". Both tubs have the angled backrest and straight vertical walls. The increased floor area and air volume in the tub of this invention is due to the 1" wall thickness and decks (on 3 edges) vs. the decks of the prior art tub which reduce the internal dimensions.

The results of the comparison are as follows:

Interior Floor Area prior art 1120 sq. in.

this tub 1419 sq. in., a 27% increase.

Interior Air Volume prior art 16790 cubic in.

this tub 20845 cubic in., a 24% increase

Additionally, the above calculations were based upon a prior art bathtub with a front deck of 4" and a back deck of 3" with side decks of 2" in a 60 inch external length by 30 inch tub of 15" average internal depth for comparison. However, since most prior art tubs have sloping and bottom rounded sides, the numbers of this estimate represent the minimum percentage increases in interior floor area and interior volume. It is estimated that in comparison with other prior art bathtubs, with increased sloping and bottom rounded sides, the savings can be up to approximately 35% increase in interior floor area and interior air volume.

In the foregoing description, certain terms and visual depictions are used to illustrate the preferred embodiment. However, no unnecessary limitations are to be construed by the terms used or illustrations depicted, beyond what is shown in the prior art, since the terms and illustrations are exemplary only, and are not meant to limit the scope of the present invention.

It is further known that other modifications may be made to the present invention, without departing the scope of the invention, as noted in the appended Claims.

What is claimed is:

1. A bathtub comprising:

substantially vertical back and front walls, first and second side walls, and a flat bottom wall, all of said walls being of rigid material, entry and egress of a user being over said front wall, said back wall abutting or is embedded in a bathroom wall;

said bottom wall extending to a rear, vertical surface of said front wall;

said back bathroom wall having wall tiles thereon, said back wall of said bathtub having a top edge sufficient in thickness to accommodate bottom edges of said wall tiles, when said back wall of said bathtub abuts, or is embedded in, a bathroom wall;

wherein said rear wall comprises a combination of a front rear wall portion of about one quarter inch in thickness, and a hollow air space portion of about three quarter inches extending behind said front rear wall up to the surface of the bathroom wall, to accommodate tile and tile grout therebetween;

side bathroom walls abutting said end walls of said bathtub, leaving access and egress only over said front wall of said bathtub;

said front wall in contact with said bottom wall is rounded at the intersection thereof; and, each of said bathtub walls having a thickness greater at the bottom thereof than of the top thereof to provide a slightly sloped surface for drainage or for easy removal of the bathtub from a mold.

2. The bathtub of claim 1, wherein said rear bathtub wall has a top thickness of about one inch and with a bottom thickness of about at least one and one quarter inch.

3. The bathtub of claim 1, wherein said front wall is hollow, with an outer front wall of about one quarter inch in thickness and an inner front wall of about one quarter inch in thickness, further with a hollow air space therebetween.

4. The bathtub as in claim 1 further comprising an optional attachment flange being attached to said back wall for attachment to a bathroom wall surface.

* * * * *